US010422097B2

(12) United States Patent
Reinert

(10) Patent No.: US 10,422,097 B2
(45) Date of Patent: Sep. 24, 2019

(54) TWO-PIECE POLYGON SHAPED METAL FIN TUBE FOUNDATION AND METHOD OF MAKING SAME

(71) Applicant: Gary L Reinert, Carnegie, PA (US)

(72) Inventor: Gary L Reinert, Carnegie, PA (US)

(73) Assignee: Safe Foundations Inc., Carnegie, PA (US)

( * ) Notice: Subject to any disclaimer, the term of this patent is extended or adjusted under 35 U.S.C. 154(b) by 28 days.

(21) Appl. No.: 15/722,101

(22) Filed: Oct. 2, 2017

(65) Prior Publication Data

US 2018/0080189 A1 Mar. 22, 2018

Related U.S. Application Data

(63) Continuation-in-part of application No. PCT/US2015/023781, filed on Apr. 1, 2015.

(51) Int. Cl.

| | |
|---|---|
| ***E02D 5/02*** | (2006.01) |
| ***E02D 5/14*** | (2006.01) |
| ***E02D 5/28*** | (2006.01) |
| ***E02D 27/10*** | (2006.01) |
| ***E02D 7/00*** | (2006.01) |

(52) U.S. Cl.

CPC ..... *E02D 5/285* (2013.01); *E02D 7/00* (2013.01); *E02D 27/10* (2013.01); *E02D 2200/1664* (2013.01); *E02D 2250/00* (2013.01); *E02D 2300/0032* (2013.01); *E02D 2600/20* (2013.01)

(58) Field of Classification Search

CPC ..... E02D 5/285; E02D 7/00; E02D 27/10

See application file for complete search history.

(56) References Cited

U.S. PATENT DOCUMENTS

| | | | | |
|---|---|---|---|---|
| 1,690,499 | A | 11/1928 | Nolte | |
| 2,250,908 | A * | 7/1941 | Greulich | E02D 5/28 405/280 |
| 2,454,956 | A * | 11/1948 | Young | E02D 5/60 204/196.18 |
| 4,882,891 | A | 11/1989 | Sero et al. | |
| 4,974,997 | A | 12/1990 | Sero et al. | |
| 5,570,975 | A | 11/1996 | Reinert, Sr. | |
| 6,561,736 | B1 * | 5/2003 | Doleshal | E02D 27/52 405/211 |
| 2013/0322970 | A1 | 12/2013 | Tappe | |

FOREIGN PATENT DOCUMENTS

| | | |
|---|---|---|
| WO | 2016/160002 | 6/2016 |

* cited by examiner

*Primary Examiner* — Tara Mayo-Pinnock
(74) *Attorney, Agent, or Firm* — Blynn L. Shideler; Krisanne Shideler; BLK Law Group

(57) ABSTRACT

A metal fin tube foundation includes a pair of coupled metal plates, each plate being comprised of a plurality of flat panels, wherein each panel is positioned at an angle relative to an adjacent panel, and each plate including a fin on each lateral end of each plate, wherein each fin overlaps a fin of the other metal plate forming two pairs of overlapped fins, wherein the plates are coupled along each of the two pairs of overlapped fins; wherein the plurality of panels of the coupled two metal plates form a closed perimeter polygon shape having an open interior and wherein each pair of overlapped fins form a combined fin element which extends away from the perimeter of the polygon.

19 Claims, 4 Drawing Sheets

FIG. 6A
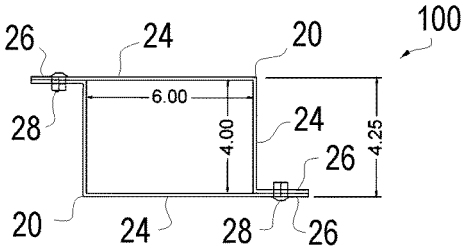
FIG. 6B
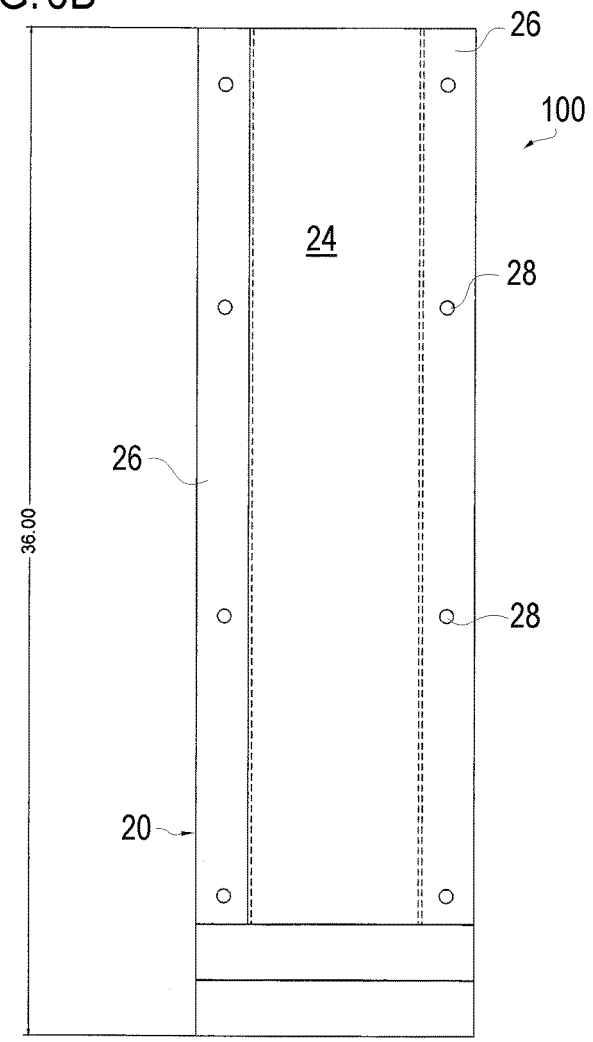
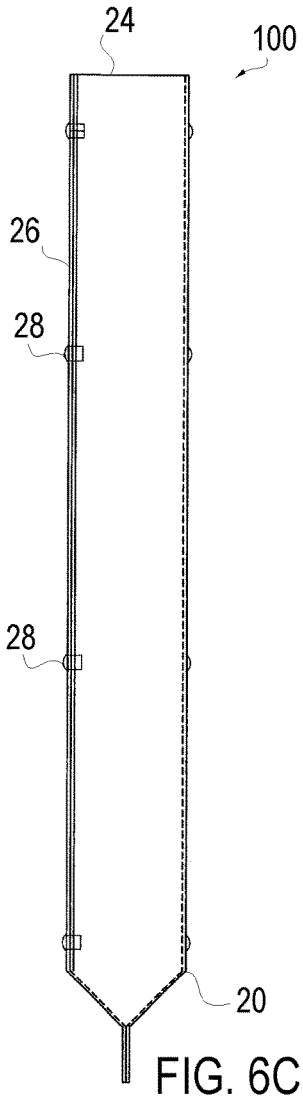
FIG. 6C

TWO-PIECE POLYGON SHAPED METAL FIN TUBE FOUNDATION AND METHOD OF MAKING SAME

RELATED APPLICATIONS

This application is a continuation in part of international patent application PCT/US15/023781 entitled "Two-Piece Non-Welded Polygon Shaped Metal Fin Tube Foundation and Method of Making Same" published as WO2016/160002 on Oct. 6, 2016 and which publication is incorporated herein by reference in its entirety.

BACKGROUND INFORMATION

1. Field of the Invention

The present invention relates to metal foundations, and more particularly to a two piece polygon shaped finned foundation and the associated method of making the same.

2. Background Information

The history of foundations is as old as the history of construction. The present invention generally relates to what is known as metal fin pipe foundations which have been used for over twenty years with great success. See for example U.S. Pat. Nos. 4,882,891, 4,974,997 and prior U.S. Pat. No. 5,570,975 all directed to methods and associated devices for installing metal fin pipe foundations, and are incorporated herein by reference.

A metal fin pipe foundation is considered to be fast and efficient as it requires no rebar, no forms, no spoils and no waiting period. Metal fin pipe foundations are pre-engineered and generally delivered to the job site ready to install in a fraction of the time it takes to install competing concrete foundations with minimal equipment, allowing the foundations to be quickly and easily installed in various soil conditions and in any weather. The structure that the metal fin pipe foundation is designed to support can be mounted to its foundation immediately following insertion.

However the current metal fin pipe foundations that are available have several disadvantages. Current metal fin pipe foundations have fins that are not integrated into the metal foundation bodies until they are welded thereto and thus welding is required to be used for assembly. Welding requires qualified people and special equipment which can add to the expense of fabricating the foundations. Further welding also generates toxic fumes which are not environmentally friendly. The metal foundation bodies of conventional metal fin pipe foundations are thus welded together in a shop and then transported on to the worksite.

Transporting pre-assembled metal fine pipe foundations limits their size and shape for shipping as height restrictions increases transportation costs. Some metal fin pipe foundations are too big to be shipped and are therefore not considered for a given job.

Further the use of pipe limits the sizes of the metal fin pipe foundation structure as the pipe will be in conventional pipe sizes, which limits the associated final design. This often results in selecting a pipe size that is far greater than the size needed for the job at hand and thus unnecessarily increases the final cost of the individual metal fin pipe foundation or results in a foundation that cannot be built and/or shipped.

These deficiencies have been addressed in part in the non-welded metal fin tube foundation disclosed in U.S. Patent Publication 2013-0322970 which is incorporated herein by reference. The '970 publication discloses a metal fin tube foundation that avoids welding, avoids the use of pre-ordered pipe, and lowers the costs relative to the prior metal fin pipe foundation.

The inventor of the present application have been working to bring the metal fin tube foundation of the type disclosed in the '970 publication to market under the brand name GREEN TUBE™ and the present invention includes all of the advantages of the foundations of the '970 application. The designs of the '970 application is distinctly lower in cost than the conventional metal fin pipe foundations, but still does not minimize the costs of the associated metal fin tube foundation nor adequately address other aspects relevant to maximum commercialization of the metal fin tube foundation concept. The present invention addresses the deficiencies of the '970 application while maintaining all the advantages of this type of metal fin tube foundation over the metal fin pipe foundation of the prior art.

SUMMARY OF THE INVENTION

The present invention addresses the deficiencies of the prior art and provides a two piece metal fin tube foundation that includes i) a pair of metal plates, each plate being comprised of a plurality of flat panels, wherein each panel is positioned at an angle relative to an adjacent panel, and each plate including a fin on each lateral end of each plate, wherein each fin overlaps a fin of the other metal plate forming two pairs of overlapped fins, and ii) a coupling of the overlapped fins; wherein the plurality of panels of the two metal plates form a closed perimeter polygon shape having an open interior and wherein each pair of overlapped fins form a combined fin element which extends away from the perimeter of the polygon.

Another aspect of the invention provides method of formation of metal fin tube foundations comprising the steps of:

a. Nesting a plurality metal plates in one or more nested stacks, each plate being comprised of a plurality of flat panels, wherein each panel is positioned at an angle relative to an adjacent panel, and each plate including a fin on each lateral end of each plate;
b. Transporting the nested plurality of metal plates to a foundation installation location;
c. Aligning the fins of a pair of metal plates from the nested plurality of metal plates, whereby each fin overlaps a fin of the other metal plate forming two pairs of overlapped fins;
d. coupling the pair of metal plates along each of the two pairs of overlapped fins, wherein the plurality of panels of the two metal plates form a closed perimeter polygon shape having an open interior and wherein each pair of overlapped fins form a combined fin element which extends away from the perimeter of the polygon.
e. Repeating steps C-D.

Other aspects of the present invention include providing that the pair of combined fin elements for each metal fin tube foundation extend along a common plane. Additionally, prior to the nesting of the metal plates, the method of manufacturing the metal fin tube foundation includes the steps of cutting each metal plate from a flat metal plate and bending each cut flat metal plate to form the metal plates that are nested. Further mechanical fasteners may be used to couple the pair of metal plates along each of the two pairs of overlapped fins to form a non-welded foundation, and it is advantageous if the mechanical fasteners for each foundation are rivets. Further, the closed perimeter polygon shape for each foundation generally includes three to twelve panels, possibly five to ten panels. Further the non-welded metal fin tube foundation may include a top plate which is mechanically fastened to at least one and generally at least two panels of each metal plate. Further, both plates for each non-welded metal fin tube foundation may include the same number of panels and may be substantially identical, whereby the number and width of panels of each plate is the same and the width of the fins is the same.

These and other advantages are described in the brief description of the preferred embodiments in which like reference numeral represent like elements throughout.

BRIEF DESCRIPTION OF THE FIGURES

FIG. 6A is a top plan view of assembled metal plates forming the two piece polygon shaped metal fin tube foundation according to one specific of the present invention;

FIG. 6B is a front elevation view of the two piece polygon shaped metal fin tube foundation of FIG. 6A; and FIG. 6C is a side elevation front view of the two piece polygon shaped metal fin tube foundation of FIG. 6A.

DESCRIPTION OF THE PREFERRED EMBODIMENTS

Figure 4:
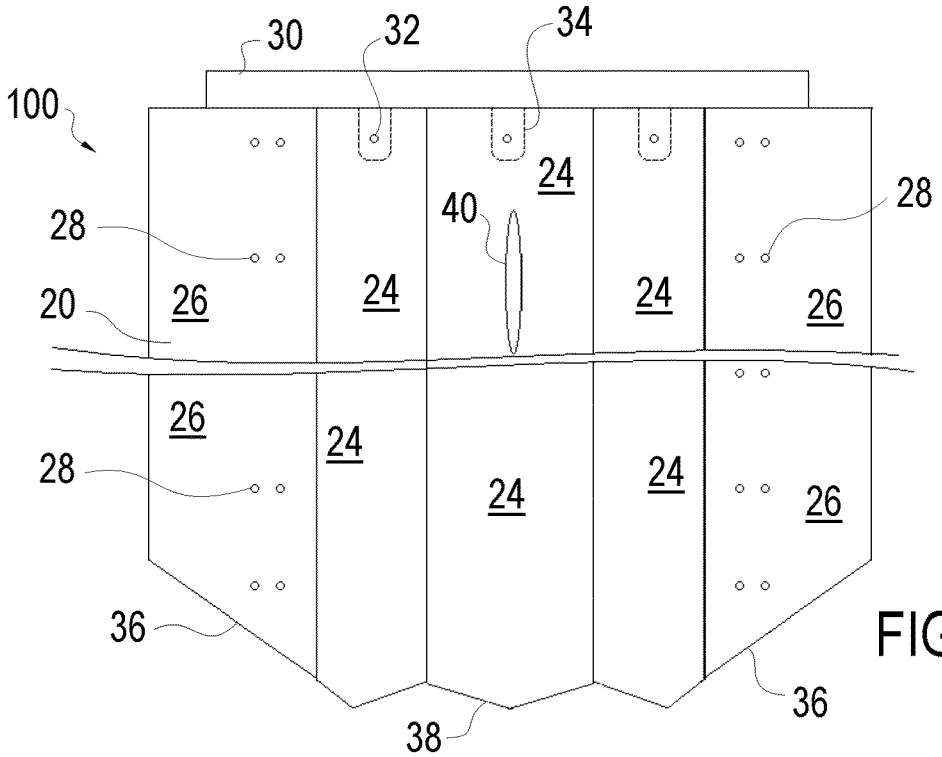
FIG. 4 is a schematic side elevation view of the two piece polygon shaped metal fin tube foundation of FIG. 3A, wherein the intermediate portions of the foundation are omitted for clarity.
Figure 5A:
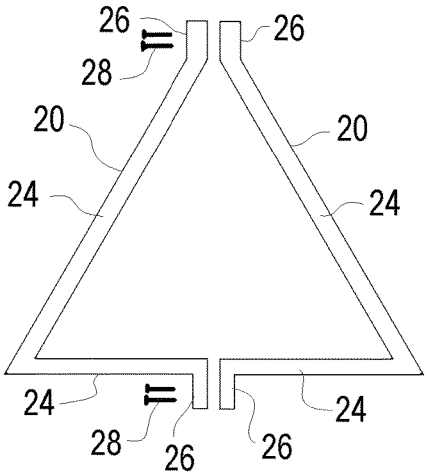
FIGS. 5A-5D is a schematic exploded top plan views of assembled metal plates forming the two piece polygon shaped metal fin tube foundation according to further aspects of the present invention, wherein the top plates of each foundation has been removed for clarity.
Figure 5C:
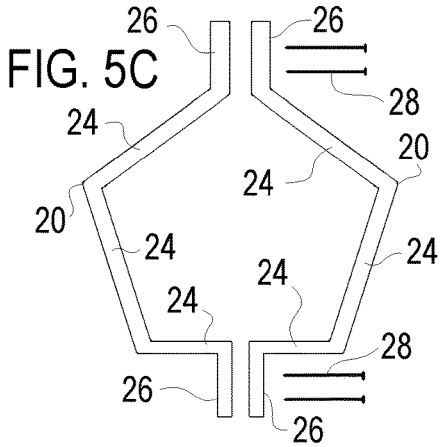
Figure 5B:
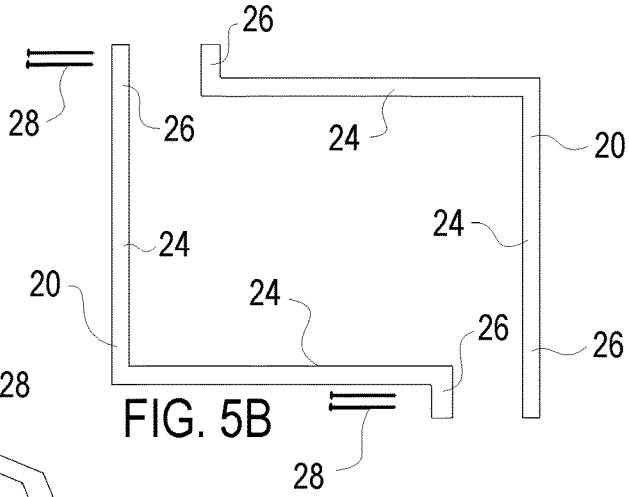
Figure 5D:
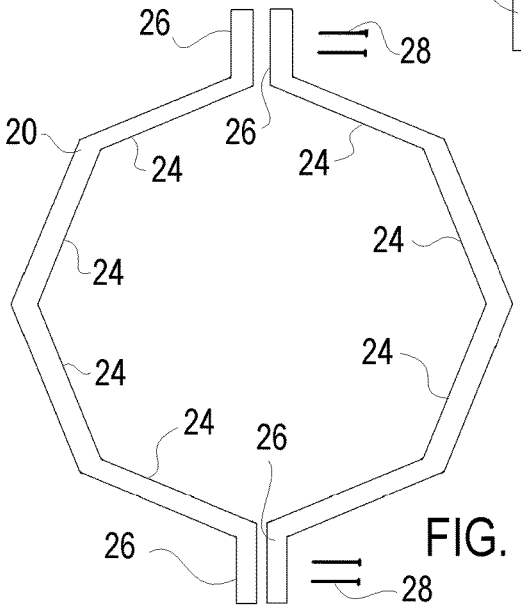

As detailed below, and particularly shown in FIG. 4, the present invention provides a two piece metal fin tube foundation 100 including a pair of metal plates 20, each plate 20 being comprised of a plurality of flat panels 24, wherein each panel 24 is positioned at an angle relative to an adjacent panel 24, and each plate 20 including a fin 26 on each lateral end of each plate 20, wherein each fin 26 overlaps a fin 26 of the other metal plate 20 forming two pairs of overlapped fins 26. The plates 20 are coupled together such as using a plurality of mechanical fasteners 28 provided along each of the two pairs of overlapped fins 26 for mechanically fastening the two plates 20. Alternatively the plates 20 may be welded together. The plurality of panels 24 of the coupled two metal plates 20 form a closed perimeter polygon shape (triangle, square, hexagon, octagon, etc) having an open interior and wherein each pair of overlapped fins 26 form a combined fin element which extends away from the perimeter of the polygon. A top plate 30 is secured to the metal plates 20, and this coupling may be through welding or through mechanical fasteners 32. The foundation 100 is a fast and efficient choice for foundations as it requires, no rebar, no forms, no spoils and no waiting period. Where welding is a concern the alternative use of fasteners 28 yield a weldless foundation, if desired.

The two piece metal fin tube foundation 100 will be pre-engineered and generally delivered to the job site ready to assemble and install in a fraction of the time it takes to install competing concrete foundations with virtually no digging and minimal equipment, allowing the foundations to be quickly and easily installed in various soil conditions and in any weather.

The structure that the two piece metal fin tube foundation 100 is designed to support can be mounted to the two piece metal fin tube foundation 100 immediately following insertion. The two piece metal fin tube foundation 100 is far more cost effective than prior art metal fin pipe foundations due to easier and faster fabrication, the ability to select a wide variety of sized plate thicknesses (rather than be limited to standard pipe thickness), and the ability to transport to the job site at a fraction of the cost. As described in greater detail below the two piece metal fin tube foundation 100 is more cost effective in design than the known non-welded metal fin tube foundation, such as disclosed in U.S. Patent Publication 2013-0322970 (which is incorporated herein by reference) due to the top plate construction and the provision of a two piece dual fin polygon body design shown herein. The foundation 100 of the present invention also maintains all of the advantages of U.S. Patent Publication 2013-0322970.

One key aspect of the present invention is the ability to select the plate thickness for plate 20 (with panels 24 and fins 26) that is needed for the associated foundation application. Steel plates 10 come in a far greater range of thicknesses and grades than do conventional pipes. Thus for the vast majority of applications the two piece metal fin tube foundation 100 of the present invention will be designed with a lighter steel plate 10 than a comparable metal fin pipe foundation which typically will select a larger pipe size than needed. The two piece metal fin tube foundation 100 will be engineered for the given application, which will take into account the structure being supported on the two piece metal fin tube foundation 100, the environmental conditions on the associated structure supported on the two piece metal fin tube foundation 100 and the soil type in which the two piece metal fin tube foundation 100 is placed.

The two piece metal fin tube foundation 100 of the present invention gives that engineer a number of variables to work with to best accommodate and design a given metal fin tube foundation 100, such as the particular number of panels 24 for each plate 20, the relative widths of each panel 24 and the relative widths of each fin 26. It should be noted that the drawings of the non-welded metal fin tube foundation 100 and associated plates 20 are only schematic and the range of sizes of the fins 26 is quite large in practice.

The length of the fins 26 may be considerably larger than the diameter of the tube formed by the panels 24 of the plates 20. A key feature of the two piece metal fin tube foundation 100 is that the panels 24 are flat elements that will resist turning (sometimes called torsional resistance) of the metal fin tube foundation 100, thus the use of the panels 24 allows the metal fin tube foundation 100 to be designed with only a pair of fins formed by combined pairs of fins 26.

The foundation 100 is referenced as a two piece structure because the two plates 20 form the body of the foundation 100 and the top plate 30 may be considered as a base of the structure supported on the foundation 100. Further the foundation 100 may have the plates 20 welded together, or alternatively may use the fasteners 28 and 32 for a weldless configuration. In a weldless configuration for the foundation 100, in addition to the number, length, and width of panels 24 and fins 26, the engineered design will identify the number and position of holes for fasteners 28 and the number and position of holes for fasteners 32 for top plate 30.

Further the engineered design of the foundation 100 will designate the end structure 36 of the fins 26 and the end structure 38 of the panels 24. The end structures 36 and 38 will typically be angled as shown in FIG. 4 to facilitate installation and may likely be beveled (i.e. sharpened to a point across the edge) to also facilitate installation. The design may include access openings 40 into the interior of the tube formed by panels 24, which may be used, for example, to run electrical wiring for lights or the like on the structure supported by the metal fin tube foundation 100 (e.g., a light pole).

Figure 1:
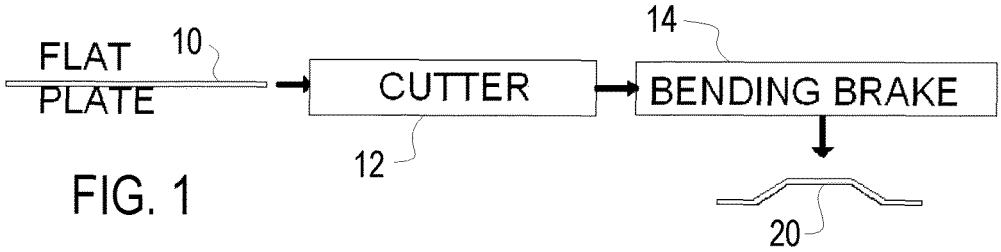
FIG. 1 is a schematic illustration of the manufacturing of individual metal plates forming a two piece polygon shaped metal fin tube foundation according to one aspect of the present invention.
Figure 3A:
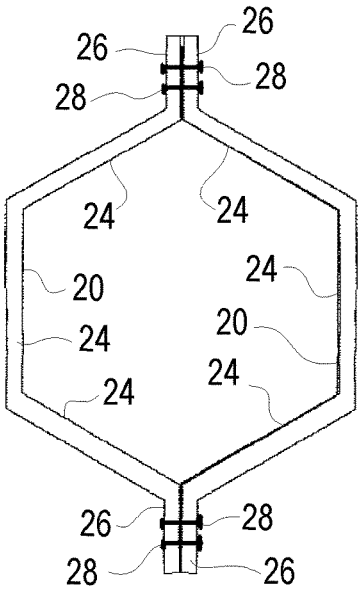
FIG. 3A is a schematic top plan view of assembled metal plates forming the two piece polygon shaped metal fin tube foundation according to one aspect of the present invention, wherein the top plate has been removed for clarity.
Figure 3B:
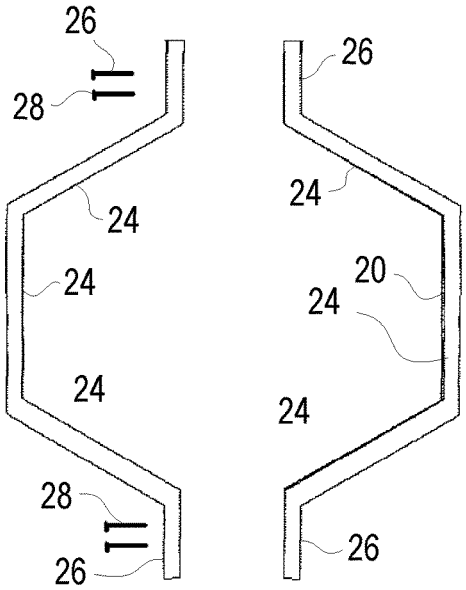
FIG. 3B is a schematic exploded top plan view of the metal plates of FIG. 3A.
Figure 3C:
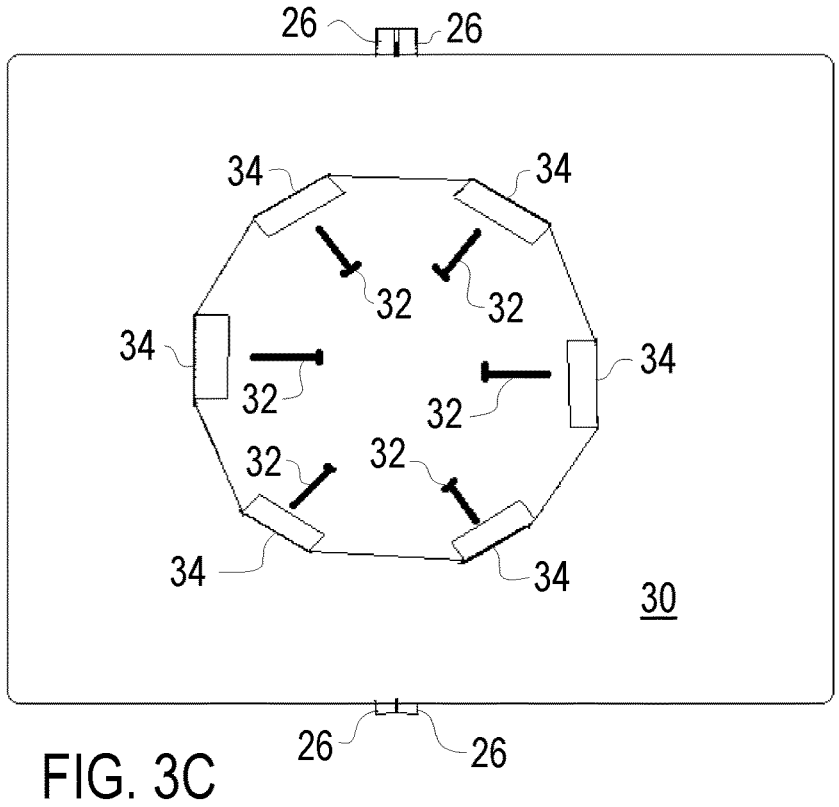
FIG. 3C is a schematic partially exploded top plan view of the two piece polygon shaped metal fin tube foundation of FIG. 3A.

FIG. 1 is a schematic illustration of the manufacturing of individual metal plates 20 forming the polygon shaped metal fin tube foundation 100 of FIGS. 3A, B and C. Following the engineers design of a given metal fin tube foundation 100, a desired plate 10 is selected and moved to a plasma cutter 12 which will make at least the cuts for the openings (if present) for the fasteners 28, the holes for the fasteners 32 (if present), the access openings (if any) 40, and the formation of the bottom structures 36 and 38. Plasma cutters, such as 12, are well known in the industry and yield advantages over mechanical cutting such as easier work holding and reduced contamination of work piece since there is no cutting edge which can become contaminated by the material or contaminate the material. In the manufacture of the metal fin tube foundation 100 of the present invention the plasma cutter 12 may be replaced with a laser cutter or a water jet cutter or a mechanical cutter as desired, however the plasma cutter 12 is deemed to yield some cost effective advantages.

The cut panels 10 are then moved to a bending brake 14, generally called a press brake or brake press. The brake 14 is often identified by basic parameters, such as the force or tonnage and the working length of the brake 14. Additional relevant brake 14 parameters include the amplitude or stroke, the distance between the frame uprights or side housings, distance to the back gauge, and work height. The upper beam usually operates at a speed ranging from 1 to 15 mm/s. Hydraulic brakes produce accurate high quality products are reliable, use little energy and are safer because, unlike flywheel-driven presses, the motion of the ram can be easily stopped at any time in response to a safety device i.e. a light curtain. A back gauge is a device that can be used to accurately position a piece of metal so that the brake puts the bend in the correct place. Furthermore the multi-axis computer-controlled back gauge can be programmed to move between bends to repeatedly make complex parts, back gauges. Optical sensors allow operators to make adjustments during the bending process. These sensors send real-time data about the bending angle in the bend cycle to machine controls that adjust process parameters.

The top plate 30 will follow a similar manufacturing process in that an appropriate plate is selected and is cut to shape on a cutter (laser cutter or plasma cutter or the like) to form the perimeter and the central opening with connecting flanges 34 and with optional holes in the flanges 34 for fasteners 32. The connecting flanges 34 will be bent generally to extend perpendicular to the main portion of the plate 30 via a brake such that each connecting flange 32 will align with an associated panel 24 and holes for the fasteners 32 will align.

Figure 2:
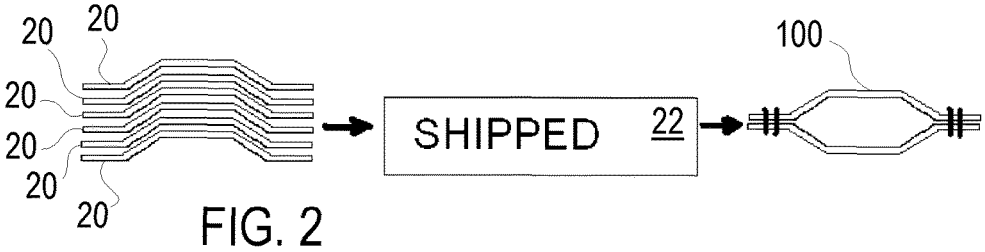
FIG. 2 is a schematic illustration of the shipping and in-situ assembly of individual metal plates forming the two piece polygon shaped metal fin tube foundation according to one aspect of the present invention.

After the formed plate 20 exits from the brake 14 and as shown in FIG. 2, the plates 20 of the present invention may be hot dipped galvanized to protect the raw steel and then may be easily nested or stacked to facilitate shipping (and storage if needed). The stacked or nested plates 22 may be shipped at 22 to the location (typically via a truck) for in-situ assembly into the foundation 100. The preformed top plates 30 will be similarly shipped, typically on the same truck. The nesting plates 20 allow a large number of foundations 100 to be shipped in a single truck.

The top plates 30 may also be galvanized and these also form a relatively compact structure when grouped so that the capacity of the shipping truck may be fully realized and greatly decrease the shipping costs associated with the foundations 100 compared with prior art foundations, such as metal fin pipe foundations.

On site the non-welded metal fin tube foundations 100 are assembled through the use of mechanical fasteners 28 and 32. Any mechanical fasteners can be utilized such as nuts and bolts huck bolts, rivets, clips, studs and clamps. The invention may be expedited with the use of blind rivets, commonly referred to as "pop" rivets (POP® is the brand name of the original manufacturer, now owned by Stanley Engineered Fastening, a division of Stanley Black & Decker) which rivets are generally tubular and are supplied with a mandrel through the center. Blind rivets for fasteners 28 and 32 may be the most expeditious fasteners and the use of these is extremely well known to make assembly by any workforce easy.

The non-welded metal fin tube foundations 100 of the present invention are better than the conventional metal fin pipe foundations as noted above and further because the bending and forming the multiple different angles between the panels 24 strengthens the structure of the resulting polygon, whereby the thickness of metal can be less than the standard pipe required when using the metal fin pipe foundation.

Also, as noted above current metal fin pipe foundations have the disadvantage of requiring welding which sometimes adds to expense of fabricating the foundations and is "environmentally unfriendly". Further the present invention can optionally also eliminate the welding needed for the top plate 30 with the innovative design. Thus the disclosed non-welded embodiment of the metal fin tube foundation 100 eliminates the welding expense and hazards of prior art structures. Further because the foundation is assembled out of plates 20 with integrated fins 26, the foundation 100 can be any practical polygon shape necessary; from a three to twelve sided polygon shape section of tubes. Larger foundations may generally require more sides which increase the number of angles necessary. The more panels 24 that are provided, generally the more obtuse the angle can be between adjacent sections. Additionally the width and relative angles between sections need not be equal. The disclosed metal fin tube foundations 100 allows for a lot of flexibility in engineering designs for foundations. Any practicable size, shape, thickness or length can be accommodated by the disclosed invention. The metal fin tube foundation 100 of the disclosed invention can be comprised of plates 20 generally of steel with any grade and thickness necessary to meet the load requirements of a specific project.

The metal fin tube foundation 100 of the disclosed invention can be installed in the ground to any depth by any means known in the art including but not limited to vibrating, puling or driving (see the methods of the above cited patents for more details for installation methods).

FIG. 6A is a top plan view and FIGS. 6B and C are front and side elevation views of assembled metal plates 20 forming the polygon shaped metal fin tube foundation 100 according to one specific embodiment of the present invention, namely forming a foundation for post mounted signs. Although it is possible to include a top plate 30 as discussed above and attach the sign post to the top plate 30, this embodiment as shown is intended to serve as a post receiving sleeve such that the tubular interior is essentially a 4" by 6" square to accommodate a conventional sign holding post therein. The material for this type of foundation may effectively be ⅛" plate steel. The bottom 2" of the foundation is flattened as shown to improve insertion and provide a sealed end for the post receiving interior. The overall length may typically be 36". This design provides huge practical advantages over alternative concrete foundations when used in signs adjacent a highway (e.g., speed limit signs and the like), relating to large savings in traffic control costs. A concrete foundation will require the presence of a concrete truck and means to load and haul away the dirt removed for the concrete and the installation is spread out over two sessions as the concrete must be left to sure. With the design of the present invention the foundation of FIGS. 6A, B and C can be pressed into the ground (with a vibratory pushing device) and the sign post and sign immediately installed, essentially using only a "rolling" traffic control as the crew rapidly installs the sign and advances to the next site along the highway. It is also contemplated that the post may be selected to have extreme tight tolerances with the tube opening of the foundation 100 so as to be effectively self shimming, which will further speed installation.

Another use of the two piece foundation 100 of the present invention having an "open bottom" (i.e. not the sealed or closed bottom embodiment of FIGS. 6A-C, is compressing the soil within the interior of the tube opening to increase the loading capacity foundation 100. Generally after the installation of the foundation 100 and before the top plate 30 (if used) an internal compressing plate of the same shape as the interior of the polygon interior is used to compress the soil within the tube formed by the coupled plates 20. The compressing plate acts as a piston and the tube acts as an associated cylinder. Once the compressing plate has compacted the soil to a desired amount the compressing plate can be coupled to the adjacent plated 20 (via welding or fasteners), alternatively dense filler added above the compressing plate, and finally the compressing plate can be removed and dense filler added to the interior above the compressed soil. Then a top plate 30 can be used on the foundation 100 with increased loading capacity due to the compressed soil.

The preferred embodiments described above are illustrative of the present invention and not restrictive hereof. It will be obvious that various changes may be made to the present invention without departing from the spirit and scope of the invention. The precise scope of the present invention is defined by the appended claims and equivalents thereto.

What is claimed is:

1. A metal tube fin foundation comprising:

a pair of metal plates, each plate being comprised of a plurality of flat panels, wherein each panel is positioned at an angle relative to an adjacent panel, and each plate including a fin on each lateral end of each plate, wherein each fin overlaps a fin of the other metal plate forming two pairs of overlapped fins;

a coupling of the pair of metal plates along each of the two pairs of overlapped fins for coupling the two plates;

wherein the plurality of panels of the coupled two metal plates form a closed perimeter polygon shape having an open interior and wherein each pair of overlapped fins form a combined fin element which extends away from the perimeter of the polygon, wherein a distal end structure of the flat plates and fins are angled relative to a longitudinal axis of the foundation; and further including a top plate immediately adjacent to a proximal end of the metal plates and fastened to at least one panel of each metal plate.

2. The metal tube fin foundation according to claim 1 wherein the pair of combined fin elements extend along a common plane, and at least one fin is spaced from the vertices of the polygon.

3. The metal tube fin foundation according to claim 1 wherein the coupling of the pair of plates includes a plurality of mechanical fasteners along each of the two pairs of overlapped fins for mechanically fastening the two plates; and wherein the top plate has a central opening.

4. The metal tube fin foundation according to claim 1 wherein the closed perimeter polygon shape includes five to twelve panels.

5. The metal tube fin foundation according to claim 1 wherein both plates include the same number of panels.

6. The metal tube fin foundation according to claim 1 wherein both plates are substantially identical, whereby the number and width of panels of each plate is the same and the width of the fins is the same.

7. The metal tube fin foundation according to claim 1 wherein the closed perimeter polygon shape is formed of panels of substantially equal width.

8. The metal tube fin foundation according to claim 1 wherein the closed perimeter polygon shape is formed of substantially identical angles between adjacent panels.

9. A method of formation of metal tube fin foundations comprising the steps of:

a. Nesting a plurality metal plates in one or more nested stacks, each plate being comprised of a plurality of flat panels, wherein each panel is positioned at an angle relative to an adjacent panel, and each plate including a fin on each lateral end of each plate wherein a distal end structure of the flat plates and fins are angled relative to a longitudinal axis of a foundation formed by the metal plate;

b. Transporting the nested plurality of metal plates to a foundation installation location;

c. Aligning the fins of a pair of metal plates from the nested plurality of metal plates, whereby each fin overlaps a fin of the other metal plate forming two pairs of overlapped fins;

d. coupling the pair of metal plates along each of the two pairs of overlapped fins, wherein the plurality of panels of the coupled two metal plates form a closed perimeter polygon shape having an open interior and wherein each pair of overlapped fins form a combined fin element which extends away from the perimeter of the polygon; and e. fastening a top plate immediately adjacent to a proximal end of the metal plates to at least one panel of each metal plate;

f) Repeating steps C.

10. The method of formation of metal tube fin foundations according to claim 9 wherein the pair of combined fin elements for each foundation extend along a common plane, and at least one fin is spaced from the vertices of the polygon.

11. The method of formation of metal tube fin foundations according to claim 9 further including prior to the nesting of the metal plates the steps of cutting each metal plate from a flat metal plate and bending each cut flat metal plate to form the metal plates that are nested.

12. The method of formation of metal tube fin foundations according to claim 9 wherein the coupling of the metal plates includes mechanically fastening the pair of metal plates with a plurality of mechanical fasteners along each of the two pairs of overlapped fins.

13. The method of formation of metal tube fin foundations according to claim 9 wherein the closed perimeter polygon shape for each foundation includes five to twelve panels.

14. The method of formation of tube fin foundations according to claim 9 wherein both plates for each foundation include the same number of panels.

15. The method of formation of metal tube fin foundations according to claim 9 wherein both plates for each foundation are substantially identical, whereby the number and width of panels of each plate is the same and the width of the fins is the same, and wherein the top plate has a central opening.

16. The method of formation of metal tube fin foundations according to claim 9 wherein the closed perimeter polygon shape for each foundation is formed of panels of substantially equal width.

17. The method of formation of metal tube fin foundations according to claim 9 wherein the closed perimeter polygon shape for each foundation is formed of substantially identical angles between adjacent panels.

18. A metal tube fin foundation for post mounted signs, comprising:

a pair of metal plates, each plate being comprised of a plurality of flat panels, wherein each panel is positioned at an angle relative to an adjacent panel, and each plate including a fin on each lateral end of each plate, wherein each fin overlaps a fin of the other metal plate forming two pairs of overlapped fins;

a coupling of the pair of metal plates along each of the two pairs of overlapped fins for coupling the two plates;

wherein the plurality of panels of the coupled two metal plates form a closed perimeter polygon shape having an open interior configured as a post receiving sleeve for receipt of a post and wherein each pair of overlapped fins form a combined fin element which extends away from the perimeter of the polygon, wherein a distal end structure of the flat plates and fins are pressed together to close the polygon and form a sealed distal end to the metal tube fin foundation meeting at a center of the foundation.

19. A metal tube fin foundation for post mounted signs according to claim 18 wherein the polygon shape is a rectangle of about 4"×6".

* * * * *